US011124929B2

(12) United States Patent
Berns et al.

(10) Patent No.: US 11,124,929 B2
(45) Date of Patent: Sep. 21, 2021

(54) SCREED ASSEMBLY ASSOCIATED WITH MACHINE

(71) Applicant: Caterpillar Paving Products Inc., Brooklyn Park, MN (US)

(72) Inventors: Reece Andrew Berns, Big Lake, MN (US); Cameron Eitel Graves, Summerset, SD (US); Bradley D. Anderson, Rogers, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 64 days.

(21) Appl. No.: 16/744,705

(22) Filed: Jan. 16, 2020

(65) Prior Publication Data

US 2020/0149230 A1 May 14, 2020

(51) Int. Cl.
*E01C 19/48* (2006.01)

(52) U.S. Cl.
CPC ..... *E01C 19/48* (2013.01); *E01C 2301/14* (2013.01)

(58) Field of Classification Search
USPC ..... 404/72, 118
See application file for complete search history.

(56) References Cited

U.S. PATENT DOCUMENTS 3,872,601 A * 3/1975 Burgin ..... E01C 19/4873 200/61.45 R
4,752,156 A * 6/1988 Owens ..... E01C 19/006 404/118
5,356,238 A * 10/1994 Musil ..... E01C 19/008 404/101
5,975,473 A * 11/1999 Haas ..... E01C 19/006 172/4
6,758,631 B2 * 7/2004 Frankeny, II ..... E01C 19/006 404/118
7,651,295 B2 * 1/2010 Eppes ..... E01C 19/48 404/84.05
9,156,498 B2 10/2015 Herzberg
9,783,056 B2 * 10/2017 Klein ..... E01C 23/088
10,209,739 B2 2/2019 Nessel
10,363,883 B2 * 7/2019 Herzberg ..... F16M 13/022
10,550,529 B2 * 2/2020 Jorgensen ..... E01C 19/48
2013/0292200 A1 * 11/2013 Herzberg ..... B60K 37/06 180/326

FOREIGN PATENT DOCUMENTS

| | | |
|---|---|---|
| CN | 101413242 | 1/2011 |
| EP | 2650440 | 8/2018 |
| JP | 09119109 | 5/1997 |

* cited by examiner

*Primary Examiner* — Raymond W Addie

(57) ABSTRACT

A screed assembly associated with a machine includes a screed disposed at a rear end of the machine and at least one control panel assembly coupled to the screed. The at least one control panel assembly includes a control panel including a recess and a support structure adapted to be removably coupled with the control panel. The support structure includes a first structure defining a first axis. The first structure is movable along the first axis and rotatable about the first axis. The support structure also includes a second structure movably coupled to the first structure. The second structure defines a second axis substantially parallel to the first axis. The second structure is rotatable about the second axis and includes a locking member adapted to be slidably received within the recess of the control panel for removably coupling the control panel with the support structure.

20 Claims, 7 Drawing Sheets

SCREED ASSEMBLY ASSOCIATED WITH MACHINE

TECHNICAL FIELD

The present disclosure relates to a screed assembly associated with a machine.

BACKGROUND

Machine, such as an asphalt paver, includes a screed to heat and/or compress paving materials, for example, asphalt, concrete, or other suitable aggregate of materials. Typically, a pair of control panels are provided at either sides of the screed. The control panels may be used to provide inputs for operation of the screed or the machine. The control panels are typically used by operators having different heights. The control panels are accessed by operators while the operators are positioned on a walkway of the screed or on a ground adjacent to the screed. Thus, a change in a horizontal position or a vertical position from the walkway to the ground on either sides of the screed may make it difficult for operators to use the control panels.

In some situations, when the control panels are not in use, it may be desirable to remove the control panels from the screed for storage purposes. The control panels that are currently available in the market use fasteners for coupling of the control panel with a portion of the screed. Thus, one or more tools may be required for removing and installing such control panels.

U.S. Pat. No. 9,783,056 describes an operator platform for a construction machine and a construction machine, particularly a road construction machine such as a road milling machine or a road paver, with an operator platform. The operator platform comprises an operator platform base, an operating panel and an operator seat, wherein an operating panel mount with a pivoting device is provided, by means of which the operating panel is pivotable about a vertical pivot axis between a first pivoting position and a second pivoting position. The operating panel mount comprises a height adjustment device which is configured such that the operating panel can be locked at different height positions independently of the pivoting positions.

SUMMARY OF THE DISCLOSURE

In an aspect of the present disclosure, a screed assembly associated with a machine is provided. The screed assembly includes a screed disposed at a rear end of the machine. The screed assembly also includes at least one control panel assembly coupled to the screed. The at least one control panel assembly includes a control panel including a recess defined at a rear surface thereof. The at least one control panel assembly also includes a support structure adapted to be removably coupled with the control panel. The support structure includes a first structure defining a first axis. The first structure is movable along the first axis and rotatable about the first axis. The support structure also includes a second structure movably coupled to the first structure. The second structure defines a second axis substantially parallel to the first axis. The second structure is rotatable about the second axis. Further, the second structure includes a locking member adapted to be slidably received within the recess of the control panel for removably coupling the control panel with the support structure.

In another aspect of the present disclosure, a support structure for a control panel associated with a machine screed is provided. The support structure includes a first structure defining a first axis. The first structure is movable along the first axis and rotatable about the first axis. The support structure also includes a second structure movably coupled to the first structure. The second structure defines a second axis substantially parallel to the first axis. The second structure is rotatable about the second axis. Further, the second structure includes a locking member adapted to be slidably received within a recess of the control panel for removably coupling the control panel with the support structure by a dovetail joint.

In yet another aspect of the present disclosure, a control panel assembly associated with a machine screed is provided. The control panel assembly includes a control panel including a recess defined at a rear surface thereof. The control panel assembly also includes a support structure adapted to be removably coupled with the control panel. The support structure includes a first structure defining a first axis. The first structure is movable along the first axis and rotatable about the first axis. The support structure also includes a second structure movably coupled to the first structure. The second structure defines a second axis substantially parallel to the first axis. The second structure is rotatable about the second axis. Further, the second structure includes a locking member adapted to be slidably received within the recess of the control panel for removably coupling the control panel with the support structure by a dovetail joint.

Other features and aspects of this disclosure will be apparent from the following description and the accompanying drawings.

DETAILED DESCRIPTION

Figure 1:
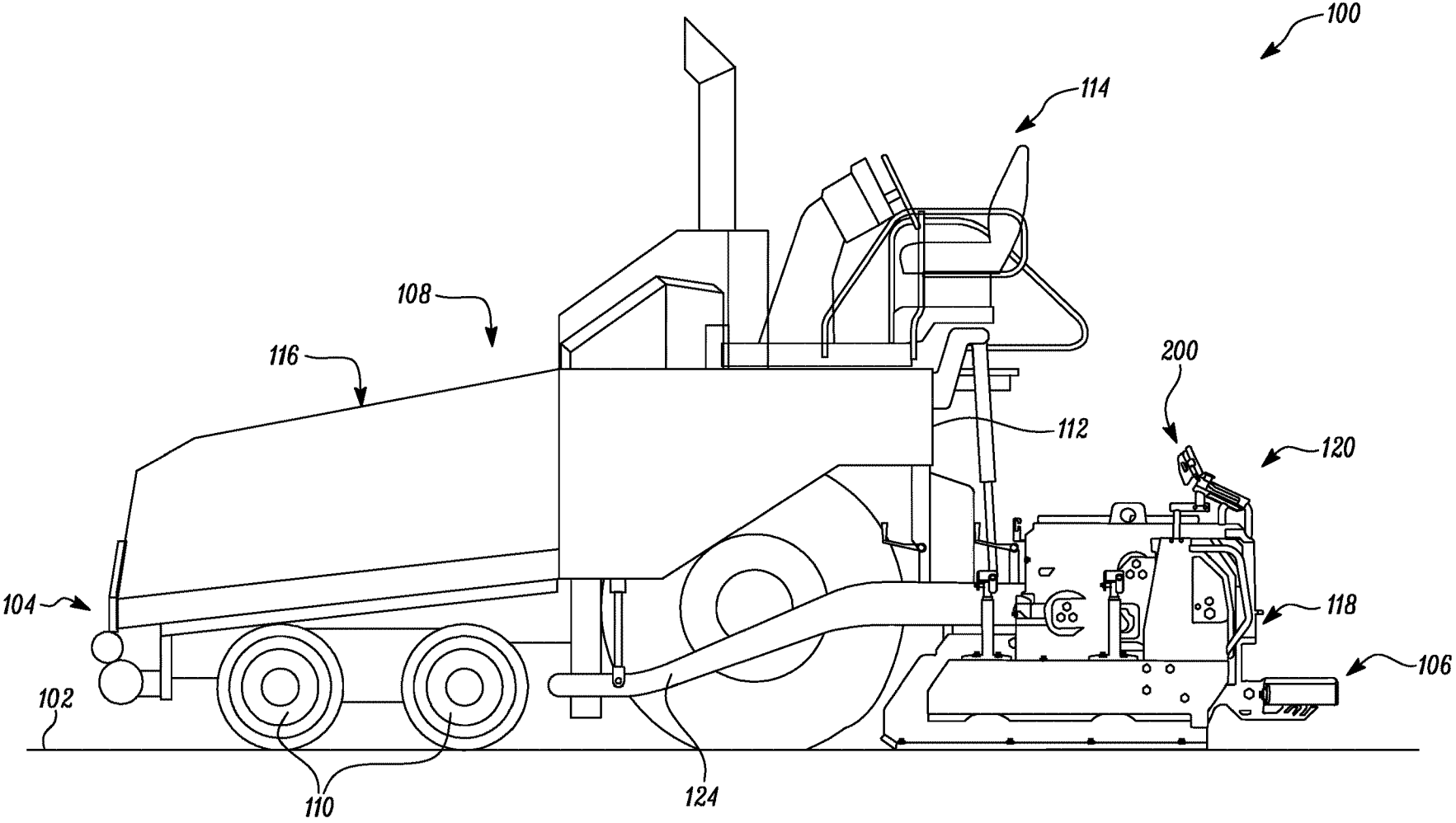
FIG. 1 is a side view of a machine, according to one embodiment of the present disclosure.

Wherever possible, the same reference numbers will be used throughout the drawings to refer to the same or like parts. Referring to FIG. 1, a machine 100 is illustrated, according to an embodiment of the present disclosure. The machine 100 is embodied as a paver, and more particularly, an asphalt paver that may be used for laying asphalt on a ground surface 102, such as a roadway. Alternatively, the machine 100 disclosed herein may be embodied for use as, for example, a concrete paving machine or another paving machine that can be used to lay other suitable aggregates of base materials known to persons skilled in the art.

The machine 100 defines a front end 104 and a rear end 106. The machine 100 includes a tractor 108 to propel the machine 100 on the ground surface 102. In the present embodiment, the tractor 108 is a wheel type tractor including a number of wheels 110 for providing traction between the tractor 108 and the ground surface 102. In another embodiment, the tractor 108 may have tracks instead of the wheels 110 disclosed herein. These tracks, also known as crawlers, provide traction between the tractor 108 and the ground surface 102. In yet another embodiment, the tractor 108 may also include a combination of tracks and wheels for providing traction between the tractor 108 and the ground surface 102.

The machine 100 also includes a power source (not shown) for propelling the tractor 108. The power source may be disposed in the tractor 108 to drive the number of wheels 110 for propelling the tractor 108. The power source may be, but not limited to, an internal combustion engine or a hybrid engine using batteries or another source of electrical power. The machine 100 may further include a generator (not shown) coupled to the power source. The generator may supply electric power to various electric components of the machine 100.

The tractor 108 includes a frame 112 that supports various components of the machine 100 including, but not limited to, an operator station 114, a hopper 116, and a screed assembly 118. When the machine 100 is embodied as a manual or semi-autonomous machine, an operator of the machine 100 may sit or stand at the operator station 114 to operate the machine 100. The operator station 114 may include various input devices, such as, control levers and switches for the operator to control various parameters of a paving operation associated with the machine 100.

Further, the hopper 116 is coupled to the frame 112 at the front end 104 of the machine 100. The hopper 116 may receive paving material from another machine, for example, a truck. The hopper 116 may include a conveyor (not shown) for transferring the paving material towards the rear end 106 of the machine 100. An auger (not shown) may also be installed at the rear end 106 to evenly distribute the paving material in front of the screed assembly 118.

Figure 2:
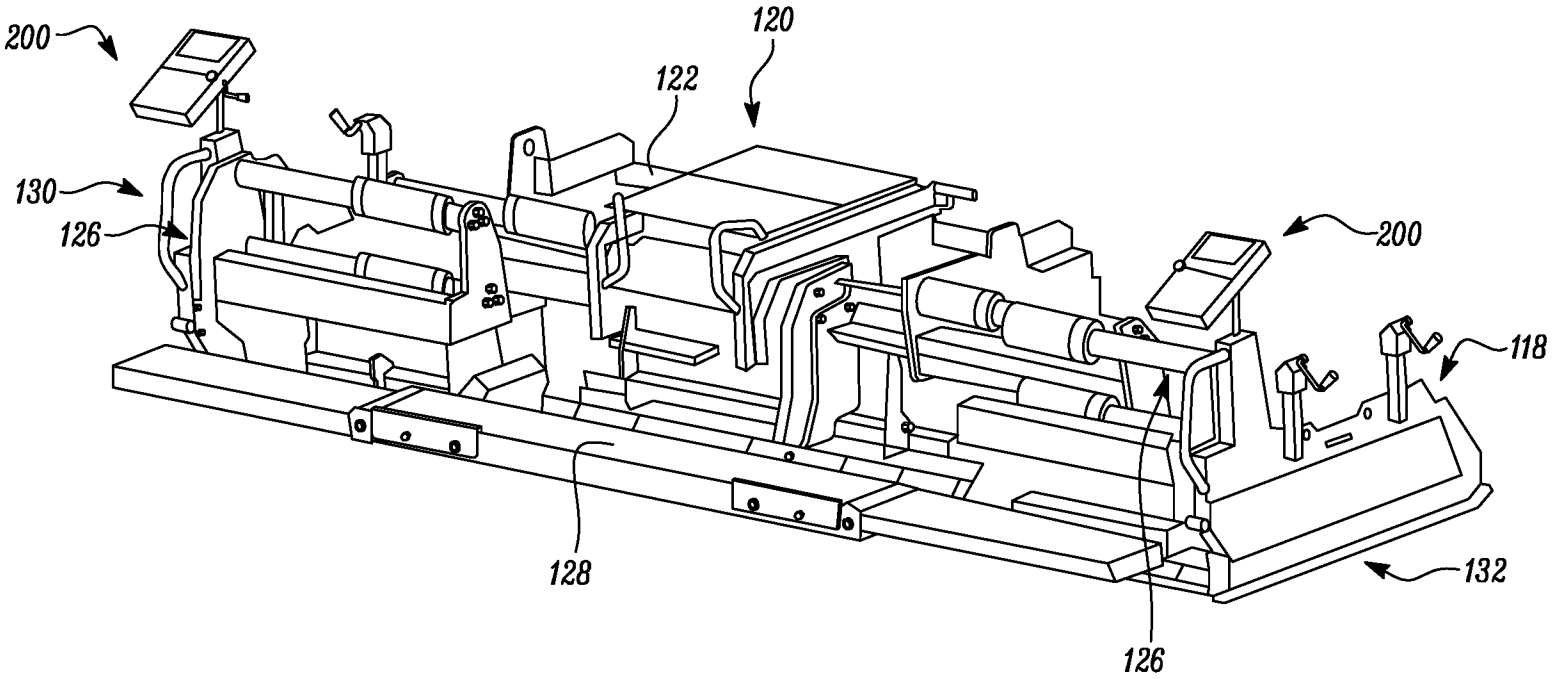
FIG. 2 is a perspective view of a screed assembly associated with the machine of FIG. 1, according to one embodiment of the present disclosure.

Further, the screed assembly 118 is associated with the machine 100. The screed assembly 118 includes a screed 120 disposed at the rear end 106 of the machine 100. The screed 120 spreads and compacts the paving material deposited on the ground surface 102. As shown in FIG. 2, the screed 120 includes a screed frame 122 and a screed plate (not shown) mounted on the screed frame 122. The screed frame 122 is movably coupled to the frame 112 (see FIG. 1), via a pair of arms 124 (one arm 124 is shown in FIG. 1). The screed plate compacts the paving material deposited on the ground surface 102. Specifically, the screed plate contacts the paving material deposited on the ground surface 102 to level the deposited paving material with respect to the ground surface 102.

In an embodiment, the screed 120 additionally includes a pair of screed extension assemblies 126 that are disposed on opposite sides 130, 132 of the screed frame 122. Each screed extension assembly 126 is moveably coupled to the screed frame 122. The screed extension assemblies 126 may contact the paving material deposited on the ground surface 102 in association with the screed plate for leveling the deposited paving material with respect to the ground surface 102.

The machine 100 is also equipped with a rearwardly extending walkway 128 which runs transversely along the rear end 106 of the machine 100. An operator or personnel may stand on the walkway 128 and observe the paving operation as the machine 100 moves forward on the ground surface 102, discharging and smoothing asphalt or other paving product. While the machine 100 proceeds ahead, the operator personnel who is on the walkway 128 can also operate controls of the machine 100 and continually communicate with the operator present at the operator station 114 who is driving the machine 100 throughout the paving operation.

Further, the screed assembly 118 includes a control panel assembly 200 coupled to the screed 120. In the illustrated embodiment, the screed assembly 118 includes a first control panel assembly 200 disposed at the first side 130 of the screed 120 and a second control panel assembly 200 disposed at the second side 132 of the screed 120. The operator or a personnel in-charge of the paving operation or the machine 100 may use the control panel assembly 200 for performing one or more machine related operations. It should be noted that each of the first and second control panel assemblies 200 are similar in construction and operation. Therefore, only the first control panel assembly 200 will now be explained in detail with reference to FIGS. 3 to 7. However, it should be noted that the description provided below is equally applicable to the second control panel assembly 200, without any limitations. Further, the first control panel assembly 200 may be hereinafter interchangeably referred to as control panel assembly 200.

Figure 3:
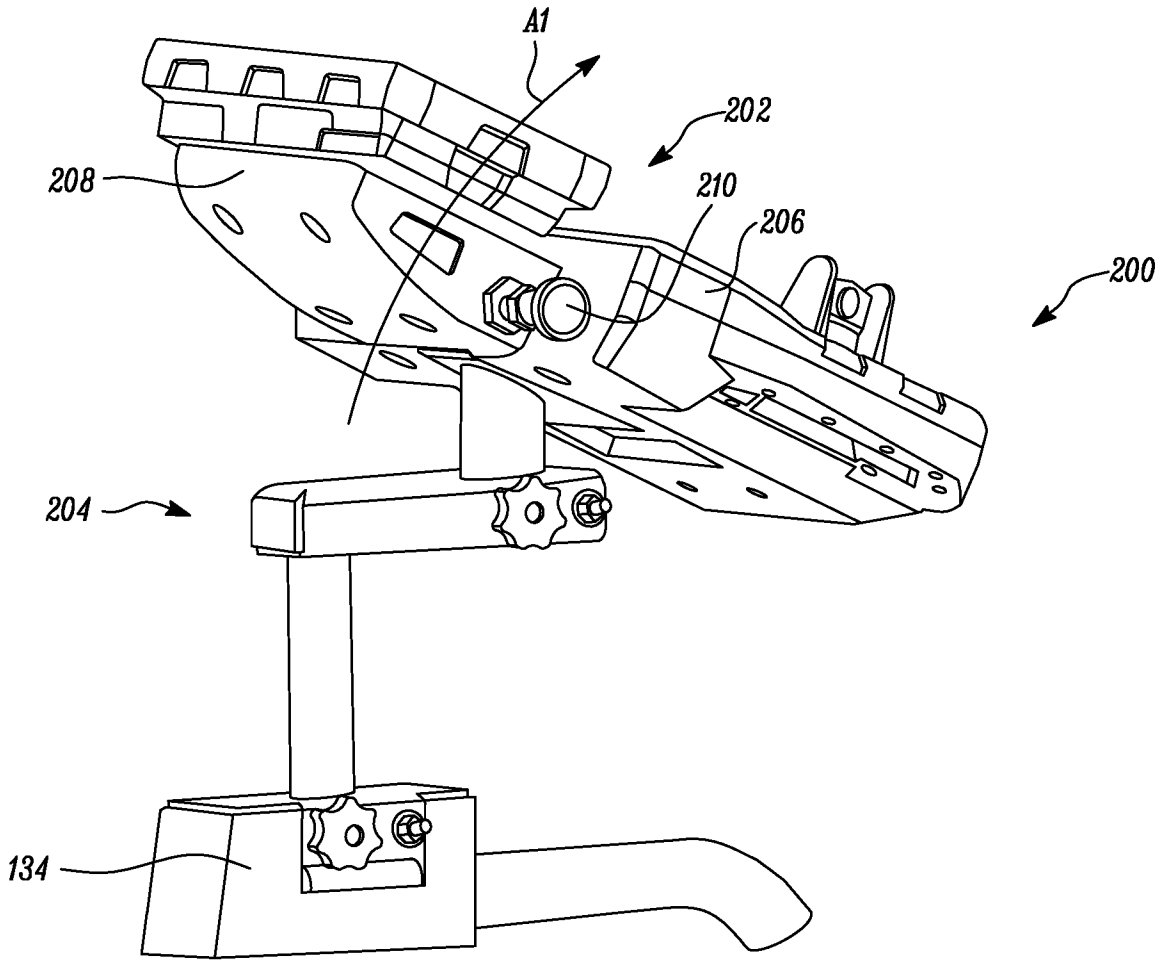
FIG. 3 is a perspective view of a control panel assembly associated with the screed assembly of FIG. 2, according to one embodiment of the present disclosure.

Referring to FIG. 3, the control panel assembly 200 includes a control panel 202 and a support structure 204 removably coupled with the control panel 202. The control panel 202 is embodied as a user interface that allows the operator or a maintenance/servicing personnel to provide inputs for performing one or more machine tasks. Further, the control panel 202 may also provide various notifications to the operator or personnel to assist in improved handling of the machine 100 (see FIG. 1).

Figure 4:
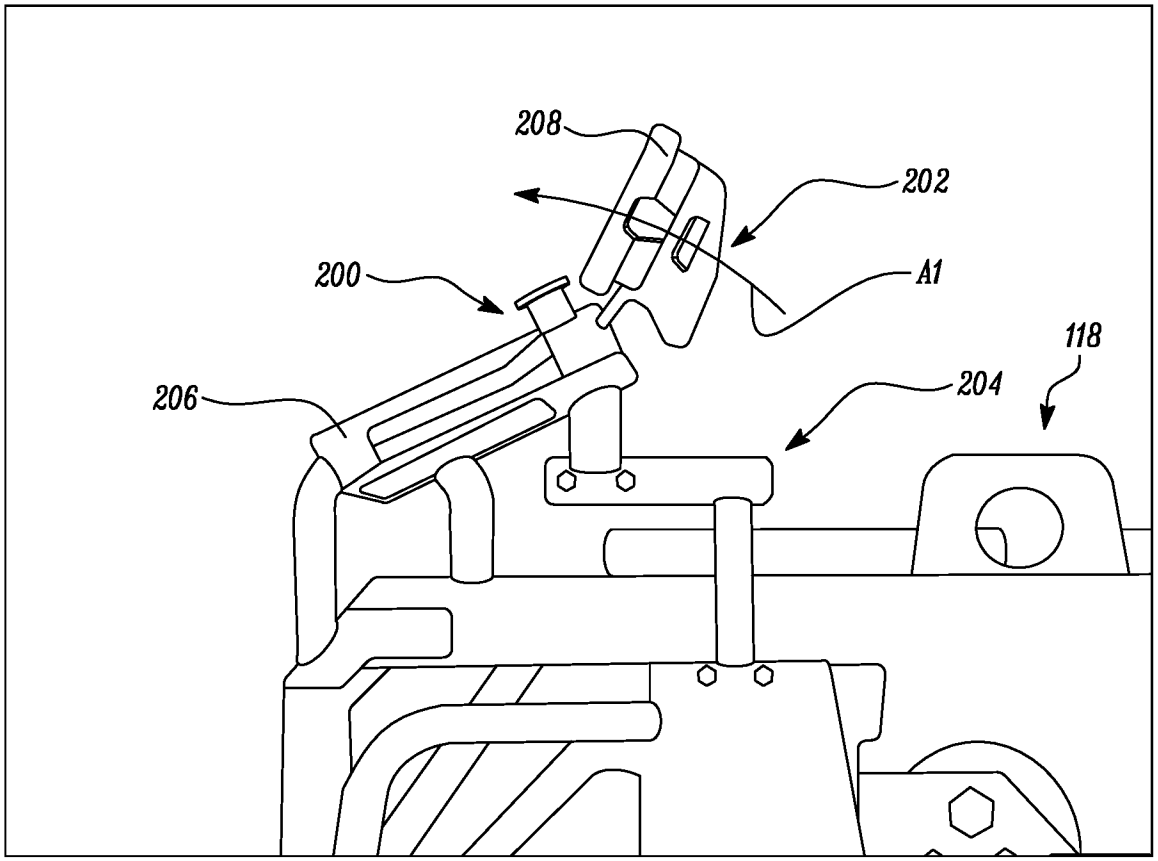
FIG. 4 is a side view of the screed assembly of FIG. 2.

The control panel 202 includes a keypad 206 and a display 208 removably coupled with the keypad 206. The operator may provide inputs via the keypad 206, whereas, notifications may be displayed on the display 208. In some examples, the display 208 may also be used to provide user inputs. In such examples, the display 208 may be embodied as a touchscreen. In other examples, the control panel 202 may omit the display 208 and only include the keypad 206. The display 208 is removably coupled with the keypad 206. Further, a position of the display 208 relative to the keypad 206 may be adjusted based on application requirements. More particularly, the display 208 is movable in a direction "A1" or in a direction that is opposite to the direction "A1". In the illustrated example, the display 208 includes a third clamp 210 for adjusting the position of the display 208 relative to the keypad 206. The third clamp 210 may be loosened to allow movement of the display 208 along the direction "A1" or in the direction that is opposite to the direction "A1". Further, as shown in FIG. 4, the display can be moved in the direction"A1", and once the display 208 is positioned at a desired angle relative to the keypad 206, the third clamp 210 (see FIG. 3) may be tightened in order to restrict any further movement of the display 208.

Figure 5:
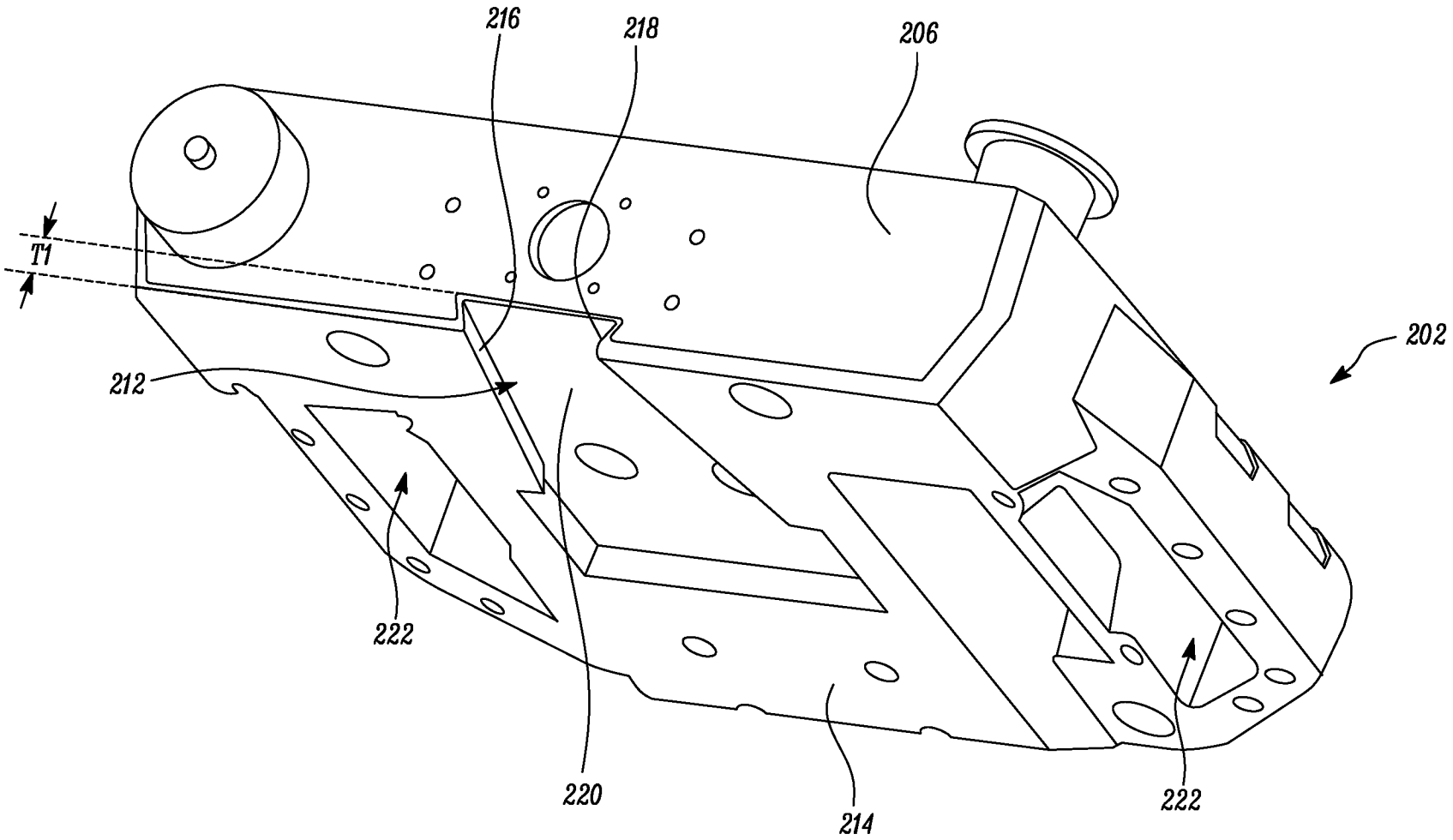
FIG. 5 illustrates a rear end of a display associated with the control panel assembly of FIG. 3.

As shown in FIG. 5, the control panel 202 includes a recess 212 defined at a rear surface 214 thereof. More particularly, the recess 212 is provided at the rear surface 214 defined by the keypad 206 of the control panel 202. The recess 212 is defined by a first side surface 216, a second side surface 218, and a bottom surface 220 extending between the first and second side surfaces 216, 218. Further, each of the first and second side surfaces 216, 218 are inclined relative to the bottom surface 220. Each of the first and second side surfaces 216, 218 define a first thickness "T1". The rear surface 214 also defines a pair of cavities 222 at the rear surface 214. The cavities 222 may provide a gripping surface for a personnel when the control panel 202 is being coupled with the support structure 204 or detached from the support structure 204.

Figure 6:
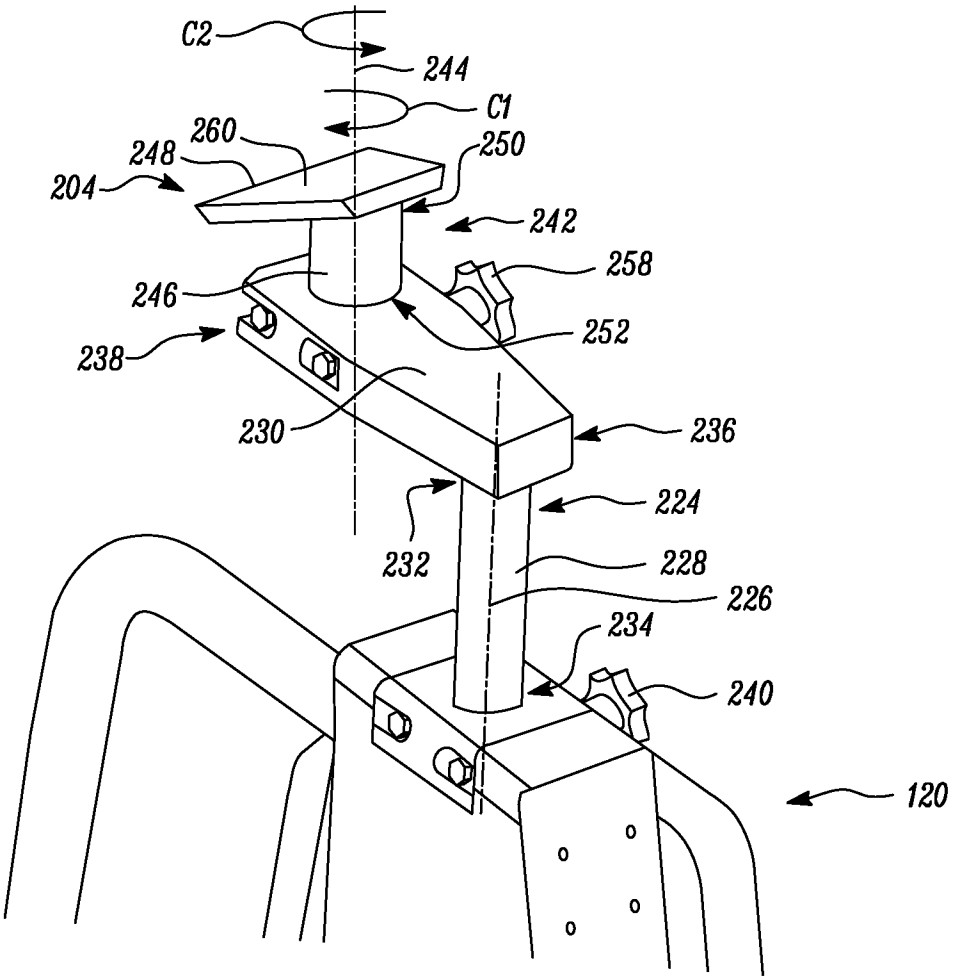
FIG. 6 illustrates a support structure associated with the control panel assembly of FIG. 3.

Referring now to FIG. 6, the support structure 204 described herein is movably coupled to the screed 120 such that the entire control panel assembly 200 may be adjusted to a desired orientation as per application requirements. Further, the support structure 204 includes a first structure 224 defining a first axis 226. The first structure 224 is movable along the first axis 226 and rotatable about the first axis 226. The first structure 224 may be disposed at different heights relative to the screed 120 based on vertical movement of the first structure 224 along the first axis 226. Further, the first structure 224 may be disposed at different orientations relative to the screed 120 based on rotational movement of the first structure 224 about the first axis 226. More particularly, the first structure 224 may be rotated in a clockwise direction "C1" or an anti-clockwise direction "C2" to adjust the orientation of the first structure 224.

The first structure 224 includes a first portion 228 defining the first axis 226 and a second portion 230 substantially perpendicular to the first portion 228. The first portion 228 is embodied as a cylindrical member that is removably coupled with a portion of the screed 120. In some examples, the first portion 228 may be coupled with the screed 120 by a threaded arrangement in order to allow movement of the first structure 224 along the first axis 226. The first portion 228 defines a first upper end 232 and a first lower end 234. Further, the second portion 230 is embodied as an elongated hollow bar member. The second portion 230 defines a first end 236 and a second end 238. A width of the second portion 230 tapers from the second end 238 towards the first end 236. Further, the first upper end 232 of the first portion 228 is fixedly coupled with the second portion 230 proximate to the first end 236 of the second portion 230.

Further, the support structure 204 includes a first clamp 240 to restrict or allow movement of the first structure 224 relative to the screed 120. The first clamp 240 is aligned and received via a through aperture (not shown) provided in a side surface 134 of the screed 120 and an aperture (not shown) provided proximate to the first lower end 234 of the first portion 228. The first clamp 240 may be loosened to allow vertical movement of the support structure 204 along the first axis 226 or to rotate the first structure 224 about the first axis 226. Further, once the first structure 224 is positioned as desired, the first clamp 240 may be tightened in order to restrict any further movement of the first structure 224.

The support structure 204 includes a second structure 242 movably coupled to the first structure 224. The second structure 242 defines a second axis 244 substantially parallel to the first axis 226. Further, the second structure 242 is rotatable about the second axis 244. More particularly, the second structure 242 is rotatable in the clockwise or anti-clockwise directions "C1", "C2". The second structure 242 includes a third portion 246 defining the second axis 244. The third portion 246 is embodied as a cylindrical member. The third portion 246 defines a second upper end 250 and a second lower end 252. Further, the third portion 246 is fixedly coupled with a locking member 248. More particularly, the second upper end 250 of the third portion 246 is fixedly coupled with the locking member 248. In some examples, the locking member 248 is coupled with the third portion 246 such that the locking member 248 is slightly inclined relative to the third portion 246.

Further, the second lower end 252 of the third portion 246 is movably coupled with the second portion 230 proximate to the second end 238 of the second portion 230. The third portion 246 is coupled with the second portion 230 by a mechanical fastener 254. The mechanical fastener 254 may embody a screw or a bolt. Further, a pair of washers 256 (one of the washer 256 is shown herein) may restrict any movement of the third portion 246 along the second axis 244. Further, the support structure 204 includes a second clamp 258 to restrict or allow rotation of the second structure 242 relative to the first structure 224. The second clamp 258 is aligns and received via a through aperture (not shown) provided in the second portion 230 and an aperture (not shown) provided proximate to the second lower end 252 of the third portion 246. The second clamp 258 may be loosened to rotate the second structure 242 about the second axis 244. Further, once the second structure 242 is positioned as desired, the second clamp 258 may be tightened in order to restrict any further rotation of the second structure 242.

Further, the second structure 242 includes the locking member 248 that is slidably received within the recess 212 of the control panel 202 for removably coupling the control panel 202 with the support structure 204. In the illustrated example, the control panel 202 is removably coupled with the support structure 204 by a dovetail joint 268 (shown in FIG. 7). The dovetail joint 268 is defined by the locking member 248 and the recess 212. The locking member 248 is generally trapezoidal in shape. The locking member 248 defines an upper surface 260 and a lower surface 262 (shown in FIG. 7) disposed opposite to the upper surface 260.

Figure 7:
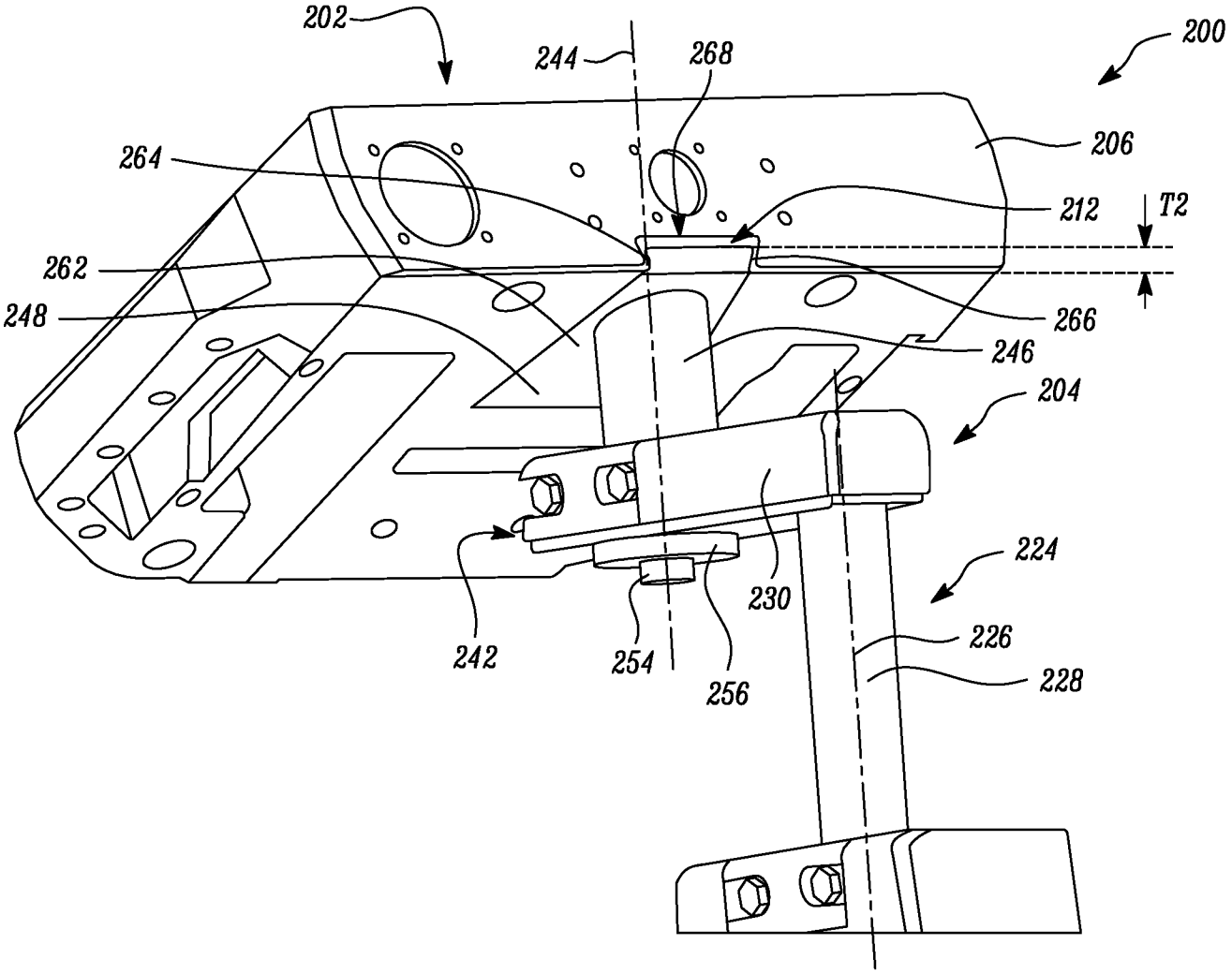
FIG. 7 illustrates a perspective view of the control panel assembly associated with the screed assembly of FIG. 2.

As shown in FIG. 7, the third portion 246 is fixedly connected to the lower surface 262 of the locking member 248. A second thickness "T2" of the locking member 248 is defined between the upper surface 260 (see FIG. 6) and the lower surface 262. The second thickness "T2" of the locking member 248 is substantially equal to the first thickness "T1" (see FIG. 5) defined by each of the first and second side surfaces 216, 218 (see FIG. 5).

Further, the locking member 248 defines a third side surface 264 and a fourth side surface 266. The third and fourth side surfaces 264, 266 are wedge shaped. More particularly, the third and fourth side surfaces 264, 266 taper from the upper surface 260 of the locking member 248 towards the lower surface 262. As the locking member 248 is received within the recess 212, an inclination of the third and fourth side surfaces 264, 266 relative to the upper surface 260 is same as an inclination of the first and second side surfaces 216, 218 relative to the bottom surface 220. This feature of the locking member 248 and the recess 212 allows the locking member 248 to be received within the recess 212 and also allows sliding of the locking member 248 in and out of the recess 212 during coupling and removal of the control panel 202, respectively.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The control panel assembly 200 associated with the screed assembly 118 described herein provides a simple, effective, and cost-efficient solution for moving the control panel assembly 200 to desired orientations. More particularly, the control panel assembly 200 includes the support structure 204, such that the support structure 204 can be moved vertically or the support structure 204 can be rotated to adjust the position of the control panel assembly 200. The control panel assembly 200 described herein has an ergonomic design. The control panel 202 of the control panel assembly 200 may be easily accessed by operators while the operators stand on the walkway 128 or on the ground surface 102 adjacent to the screed 120. Moreover, a design of the support structure 204 allows for the control panel 202 to be located in front of the operators when they are standing on the ground surface 102 next to the screed 120.

Further, the control panel assembly 200 described herein may be used by operators of different heights as a height adjustment feature provided by the first structure 224 allows the entire control assembly 200 to be raised or lowered with respect to the screed 120. Moreover, the height adjustment feature of the first structure 224 also allows the operators to access the control panel 202 in situations wherein there is a change in distance between the walkway 128 and the ground surface 102.

Further, a rotation feature of the support structure 204 may allow the control panel assembly 200 to be rotated inwards for providing clearance while performing paving operations against buildings or other obstructions. Additionally, the control panel 202 includes the display 208 that is removably coupled to the keypad 206. The display 208 is movable along the direction "A1" thereby allowing for multiple viewing angles in combination with the height adjustment feature provided by the support structure 204.

Further, the control panel 202 is locked with the locking member 248 by the dovetail joint 268, thereby eliminating removal of the control panel 202 from the support structure 204. Additionally, this technique of locking the control panel 202 with the locking member 248 allows for the control panel 202 to slide in and out of the recess 212 without usage of tools or fasteners. Thus, the control panel 202 may be easily removed and stored when the control panel 202 is not being used. Moreover, the support structure 204 is easy to design and manufacture. The control panel assembly 200 may be easily retrofitted on existing machines with limited modifications, in turn, providing flexibility and compatibility.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A screed assembly associated with a machine, the screed assembly comprising:

a screed disposed at a rear end of the machine; and at least one control panel assembly coupled to the screed, wherein the at least one control panel assembly includes:

a control panel including a recess defined at a rear surface thereof; and a support structure adapted to be removably coupled with the control panel, wherein the support structure includes:

a first structure defining a first axis, wherein the first structure is movable along the first axis and rotatable about the first axis; and a second structure movably coupled to the first structure, the second structure defining a second axis substantially parallel to the first axis, wherein the second structure is rotatable about the second axis, and wherein the second structure includes a locking member adapted to be slidably received within the recess of the control panel for removably coupling the control panel with the support structure.

2. The screed assembly of claim 1, wherein the control panel is adapted to be removably coupled with the support structure by a dovetail joint.

3. The screed assembly of claim 1, wherein the recess is defined by a first side surface, a second side surface, and a bottom surface extending between the first and second side surface, and wherein each of the first and second side surfaces are inclined relative to the bottom surface.

4. The screed assembly of claim 1, wherein the locking member defines a third side surface and a fourth side surface, and wherein each of the third and fourth side surfaces are wedge shaped.

5. The screed assembly of claim 1, wherein the first structure includes a first portion defining the first axis and a second portion substantially perpendicular to the first portion.

6. The screed assembly of claim 1, wherein the second structure includes a third portion defining the second axis, the third portion being fixedly coupled with the locking member.

7. The screed assembly of claim 1, wherein the support structure includes a first clamp adapted to at least one of restrict and allow movement of the first structure relative to the screed.

8. The screed assembly of claim 1, wherein the support structure includes a second clamp adapted to at least one of restrict and allow rotation of the second structure relative to the first structure.

9. The screed assembly of claim 1, wherein the control panel includes a keypad and a display removably coupled with the keypad, and wherein the display includes a third clamp for adjusting a position of the display relative to the keypad.

10. A support structure for a control panel associated with a machine screed, the support structure comprising:

a first structure defining a first axis, wherein the first structure is movable along the first axis and rotatable about the first axis; and a second structure movably coupled to the first structure, the second structure defining a second axis substantially parallel to the first axis, wherein the second structure is rotatable about the second axis, and wherein the second structure includes a locking member adapted to be slidably received within a recess of the control panel for removably coupling the control panel with the support structure by a dovetail joint.

11. The support structure of claim 10, wherein the recess is defined by a first side surface, a second side surface, and a bottom surface extending between the first and second side surface, and wherein each of the first and second side surfaces are inclined relative to the bottom surface.

12. The support structure of claim 10, wherein the locking member defines a third side surface and a fourth side surface, and wherein each of the third and fourth side surfaces are wedge shaped.

13. The support structure of claim 10, wherein the first structure includes a first portion defining the first axis and a second portion substantially perpendicular to the first portion.

14. The support structure of claim 10, wherein the second structure includes a third portion defining the second axis, the third portion being fixedly coupled with the locking member.

15. A control panel assembly associated with a machine screed, the control panel assembly comprising:

a control panel including a recess defined at a rear surface thereof; and a support structure adapted to be removably coupled with the control panel, wherein the support structure includes:

a first structure defining a first axis, wherein the first structure is movable along the first axis and rotatable about the first axis; and a second structure movably coupled to the first structure, the second structure defining a second axis substantially parallel to the first axis, wherein the second structure is rotatable about the second axis, and wherein the second structure includes a locking member adapted to be slidably received within the recess of the control panel for removably coupling the control panel with the support structure by a dovetail joint.

16. The control panel assembly of claim 15, wherein the recess is defined by a first side surface, a second side surface, and a bottom surface extending between the first and second side surface, and wherein each of the first and second side surfaces are inclined relative to the bottom surface.

17. The control panel assembly of claim 15, wherein the locking member defines a third side surface and a fourth side surface, and wherein each of the third and fourth side surfaces are wedge shaped.

18. The control panel assembly of claim 15, wherein the first structure includes a first portion defining the first axis and a second portion substantially perpendicular to the first portion.

19. The control panel assembly of claim 15, wherein the second structure includes a third portion defining the second axis, the third portion being fixedly coupled with the locking member.

20. The control panel assembly of claim 15, wherein the control panel includes a keypad and a display removably coupled with the keypad, and wherein the display includes a third clamp for adjusting a position of the display relative to the keypad.

* * * * *